US008122613B2

(12) United States Patent
Sanders

(10) Patent No.: US 8,122,613 B2
(45) Date of Patent: Feb. 28, 2012

(54) COMBINATION AIR PURIFIER AND CLOTHES DRYER

(76) Inventor: Thomas Sanders, San Diego, CA (US)

( * ) Notice: Subject to any disclaimer, the term of this patent is extended or adjusted under 35 U.S.C. 154(b) by 149 days.

(21) Appl. No.: 12/367,459

(22) Filed: Feb. 6, 2009

(65) Prior Publication Data

US 2010/0199513 A1 Aug. 12, 2010

(51) Int. Cl.
*F26B 21/00* (2006.01)
*F26B 19/00* (2006.01)
*F26B 25/14* (2006.01)

(52) U.S. Cl. ..... 34/565; 34/82; 34/218; 34/235; 34/239; 34/240

(58) Field of Classification Search ..... 34/72, 82, 34/524, 565, 218, 235, 239, 240
See application file for complete search history.

(56) References Cited

U.S. PATENT DOCUMENTS 5,730,006 A 3/1998 Conley et al.
RE35,834 E * 7/1998 Miller ..... 34/621
5,997,619 A * 12/1999 Knuth et al. ..... 96/224
6,327,792 B1 12/2001 Herbert

FOREIGN PATENT DOCUMENTS

SU 1617281 A * 12/1990

* cited by examiner

*Primary Examiner* — Jiping Lu
(74) *Attorney, Agent, or Firm* — Donn K. Harms

(57) ABSTRACT

A combination clothes dryer and air filter. The device is adapted for reversal of airflow through a housing to allow a horizontal position and a vertical position for operation. The device is adapted for easy storage in the horizontal position.

13 Claims, 2 Drawing Sheets

COMBINATION AIR PURIFIER AND CLOTHES DRYER

BACKGROUND OF THE INVENTION

1. Field of the Invention

The present invention relates to portable air purifiers. More particularly it relates to a device adapted to provide air purification inside a structure while concurrently providing clothes dryer and humidifier functions.

2. Prior Art

Air pollution and seasonal occurrences of pollen and dust are a major cause of illness and allergies to persons worldwide. This is especially true in industrialized countries where air pollution can cause severe reactions in people sensitive to particulate and chemicals released into the air by factories and vehicles.

As a consequence, for many people, air purifiers have gone from a convenience to a necessity necessary for their health.

Conventionally, such air purifiers employ a fan to move room air through one or a plurality of filters to remove dust, pollen, and other pollutants. Some air conditioners may also employ ionic technology to induce a charge to particulate so as to cause it to attach to wall surfaces or to filter surfaces more readily.

The fan and electronic components of such air purifiers consume energy during their use because of the constant employment of an electric fan and other components to move room air through the device during the filtration process. While the result may be cleaner room air inside the building, much energy is employed for this single task of air cleaning.

Because such air cleansing devices already employ components to cause the forced movement of air through and from a housing for the filtration system, they might also be employed for concurrent tasks which might take advantage of the air movement for other purposes. By increasing the potential work the air filtration device might accomplish, for the same amount of energy, such air filtering devices can save the user money and save valuable energy which is especially good for the environment.

In order to accomplish such tasks, the conventional air purifier needs to be modified to provide the ability to steer exhausted air from the housing, to do other tasks to which such a moving air flow can be well adapted.

One such task is the air drying of fine clothing such as silk, and other clothing which requires air drying rather than tumbling in a clothes dryer. The conventional manner for air drying of clothing is to hang the clothing on a clothes hanger in an open area in the room. Drying in this manner can take hours and tends to cause the clothing to develop winkles where it hangs on the hanger. Rust can even occur if left on metal hangers for long periods of time. Fans are sometimes employed by persons trying to speed up the process, however such fans direct airflow toward the drying clothing from the side, and this can cause damage to adjacent clothing from abrasion when the clothing hanging on a hanger is moved by the fan and continually slides and contacts clothing hanging on either side.

Another task frequently required, especially in cold climates and in homes in the desert or at high altitudes, is the humidifying of the air inside a structure. In areas where the outside temperature drops below freezing for long periods, the air inside a home or office can become extremely dry. This dry air can cause nasal and throat problems to persons exposed to it over long periods. Further, wood and other surfaces in the structure can become over-dry causing damage from shrinkage and other dry air problems.

Frequently employed for this task is the boiling of water to impart steam and thus moisture into the air, or the employment of ultra sonic devices which impart moisture particles into the air from a reservoir. The use of heat to make steam consumes large amounts of energy at significant cost and ultra sonic devices are both expensive and also use electricity to impart humidity back into the room air.

A device, such as the one disclosed herein, which can employ the same air cleaning apparatus to also dry clothing and to concurrently humidify the air inside a structure would be especially convenient to users. Such a device would also provide savings in energy from the requirement that only one device be energized to do the work of three.

Prior art has attempted to address multi-tasking when it comes to clothes drying however such devices lack function and structure to provide concurrent cleaning, drying, and humidifying.

U.S. Pat. No. 6,327,792 (Herbert) teaches a portable sports dryer for drying wearing apparel having a rigid support tube for with an open end for engaging with a clothing article for supporting it above the dryer. An electric blower communicates with the hollow support tube for circulating air to dry the clothing article, such as a sock. However, Herbert lacks support for hangers engageable with larger clothing items and any means to purify the air coming through the housing.

Another attempt at clothes drying is U.S. Pat. No. 5,730,006 (Conley) which discloses a garment de-wrinkler. Conely, while heating the overhead clothing from below, employs a conventional a garment bag with a threaded opening to communicate steam to the interior of the bag. While the clothes are engaged from below an overhead hanging position, they are steamed rather than dried and the air moving through the housing is not filtered nor is the room-air humidified.

Other devices in the prior art, employ singular tasking components to dry clothing or to humidify air, or to clean room air, individually. However, none employ the clean moving air directed from the housing of an air filtration device to evenly dry overhead hanging clothing, nor do they handle this task in a manner that will concurrently impart clean air and moisture to the surrounding room.

As such, there is a continuing unmet need for an improved air filtration device, which will concurrently provide drying of clothing with clean air that will not soil the clothing. Such a device should provide a clean airflow to clothing from below all of the overhanging clothing to evenly dry the interior hanging clothes as well as garments on the exterior of the hanging support. Such a device should direct air at the clothing in a manner that will not cause adjacent pieces of clothing to rub upon each other thereby alleviating the potential for damage to the clothing. Finally, such a device should be employable to use the moisture from the clothing being dried, to humidify room air. By concurrently providing the means for three separate activities normally handled by three appliances, such a device will save energy and be good for the environment.

SUMMARY OF THE INVENTION

The device herein disclosed overcomes the prior shortcomings and achieves the above-mentioned objects through the provision of combination air-purifier, clothes dryer, and humidifier in a single easy-to-store component.

The device features a housing which has an internal cavity for holding air filters and a fan to move air over the filters and forcing a moving flow of clean air through an exhaust. Internal conduits communicate between perpendicular side elements of the housing wherein moves into the housing from one surface and exits from a surface substantially perpendicular to the surface housing the intake.

Employing a fan that may be reversed, along with the perpendicular surface intake and exhaust ports, the device allows drying of overhead clothing in both an upright position and a laying position giving the ability to position more clothing over the exhaust vents of the device which are determined by the fan direction.

Internal filters such as HEPA filters are employed to filter pollutants and particulate from the airstream entering the housing. The filters are replaceable to allow the device to continue to clean air for its lifetime.

A rack is provided to hang clothing from on hangers. The rack is engageable to two different surfaces of the device to achieve an overhead positioning of clothing which hangs from the rack. In a first engaged position, the rack engages a short side of the housing which is elevated above the larger planar side surfaces. The rack is substantially "T" shaped and has a horizontal cross bar that is engaged in a position which is aligned with the axis of the device and centered over the short side surface. An upright support is engaged to an aperture in the short side surface, to hold the crossbar elevated.

The fan, can be switched to intake air from the larger side surfaces and exhaust it from the overhead short side surface through slots in that surface adapted to direct the exiting air in individual streams. These individual streams are directed upward toward the cross bar and dry all of the hanging clothing evenly, whether they be internally hanging adjacent to the upright support, or on the distal ends of the cross bar. This direction of moving, filtered, clean air, from below the overhanging clothing ensures even drying, prevents dirt in the airflow from dirtying the clothing, and alleviates the damage that a side directed flow of air causes since the moving air from below the clothing prevents abrasion.

The device features a housing that will also support the clothing over a larger planar side surface to allow a larger more even flow of air to reach overhanging clothing. A second aperture is positioned substantially centered in the larger planar side and the wheels are also disengageable from their engagement with wheel apertures in the short side adjacent to the floor, and engageable with secondary wheel apertures about the perimeter edge of the larger side surface positioned adjacent to the floor.

In use, the device can thus be supported on wheels engaged with a short side, to hold the housing in an elevated position with one short side positioned on top and engaging the center support for the cross bar. The housing may also be lain upon the floor with a larger side surface adjacent to the floor and supported above the floor by the wheels engaged with the secondary wheel apertures. In this position the support member for the cross bar engages with a secondary support aperture centered on the larger side surface which becomes the top surface. The fan is switchable to direct air flow to the top surface be it a short side surface or larger side surface.

The clothing hanging above the housing is thus evenly dried and the moisture from the clothing may be imparted to the room air to humidify it.

In an additional feature for storage, the support for the horizontal member, and the horizontal member itself, can be made telescopic to shrink their storage size. The housing, positioned with the wheels supporting the longer or larger side close to the floor, allows the device to assume a low profile for storage under a bed our couch. The sidewall of the device would be between four and eight inches wide to allow the device to fit under conventional beds which are generally situated between four and eight inches above the floor supporting them.

With respect to the above description, before explaining at least one preferred embodiment of the herein disclosed invention in detail, it is to be understood that the invention is not limited in its application to the details of construction and to the arrangement of the components in the following description or illustrated in the drawings. The combination air-purifier and clothes dryer invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed air purification and clothes drying device. It is important, therefore, that the claims be regarded as including such equivalent construction and methodology insofar as they do not depart from the spirit and scope of the present invention.

It is an object of this invention to provide an air purifier that will concurrently function as a clothes dryer and humidifier.

It is an additional object of this invention to provide such an air purifier and clothes dryer that provides for moving air to reach interior rack-mounted clothing to dry more evenly and also prevents the abrasion side directed airflow can cause.

These together, with other objects and advantages which become subsequently apparent, reside in the details of the construction and operation as more fully hereinafter described and claimed, reference being had to the accompanying drawings forming a part thereof, wherein like numerals refer to like parts throughout.

BRIEF DESCRIPTION OF DRAWING FIGURES

Figure 3:
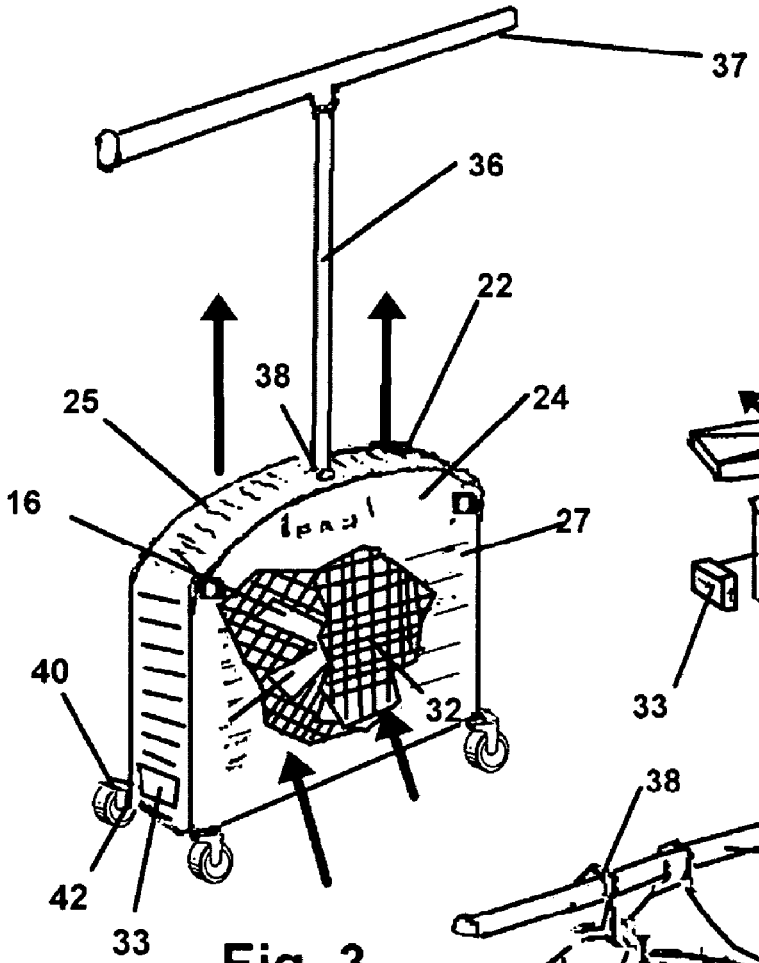
FIG. 3 depicts the airflow from the housing in the elevated position vertically disposed with the air flow reversed to exit a short side surface through directional slots.
Figure 3A:
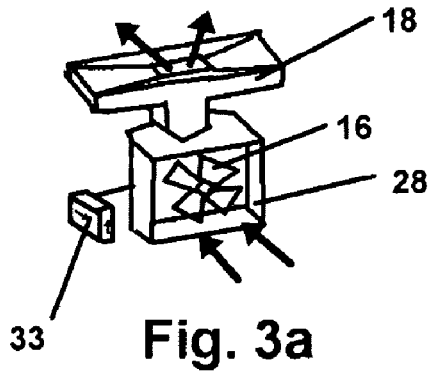

FIG. 3*a* shows the internal duct system and automatic flow reversal component depending on whether the device is vertically or horizontally disposed.

Figure 4:
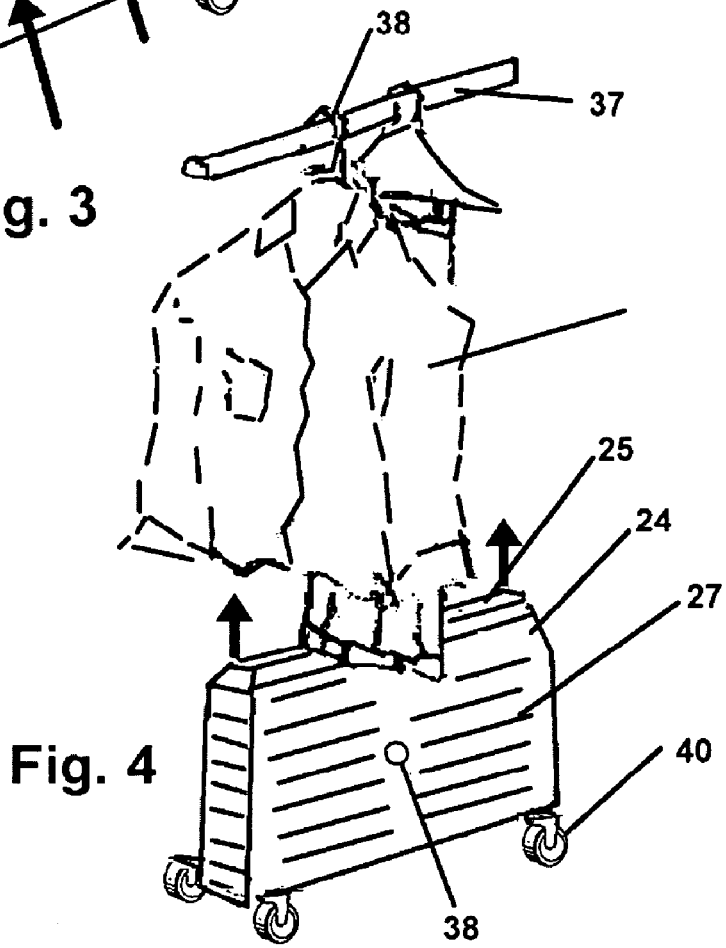

FIG. 4 shows the device with clothing engaged upon the horizontal member and the housing in the elevated position vertically disposed.

DETAILED DESCRIPTION OF THE PREFERRED EMBODIMENTS OF THE INVENTION

Referring now to the drawings of FIGS. 1-4 the device 10 has a housing 12 which has an internal cavity 12 adapted for engagement of air filters 32 and having an electric fan 16 engaged to internal conduits 18 such that air movement generated by the fan 16 may be directed into and out of the device 10 directionally, depending on its vertical or horizontal orientation for use.

Figure 1:
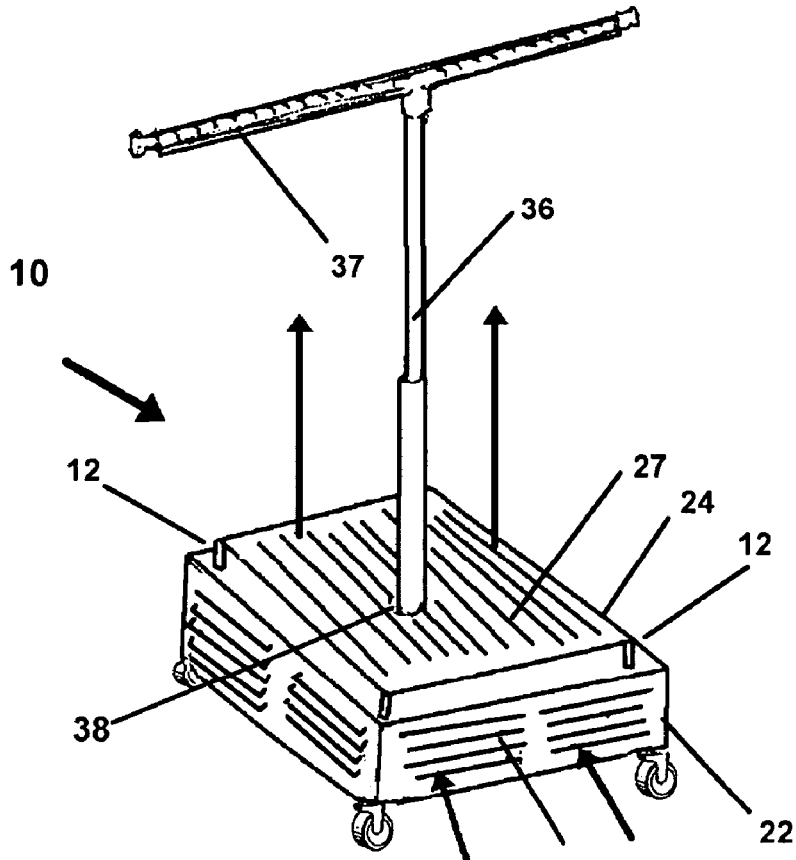
FIG. 1 depicts the device with a telescopic support engaged with the larger side surface and the housing in the horizontal position with the shorter sides perpendicular to the floor and with airflow evenly directed from slots in the upper positioned surface.
Figure 2:
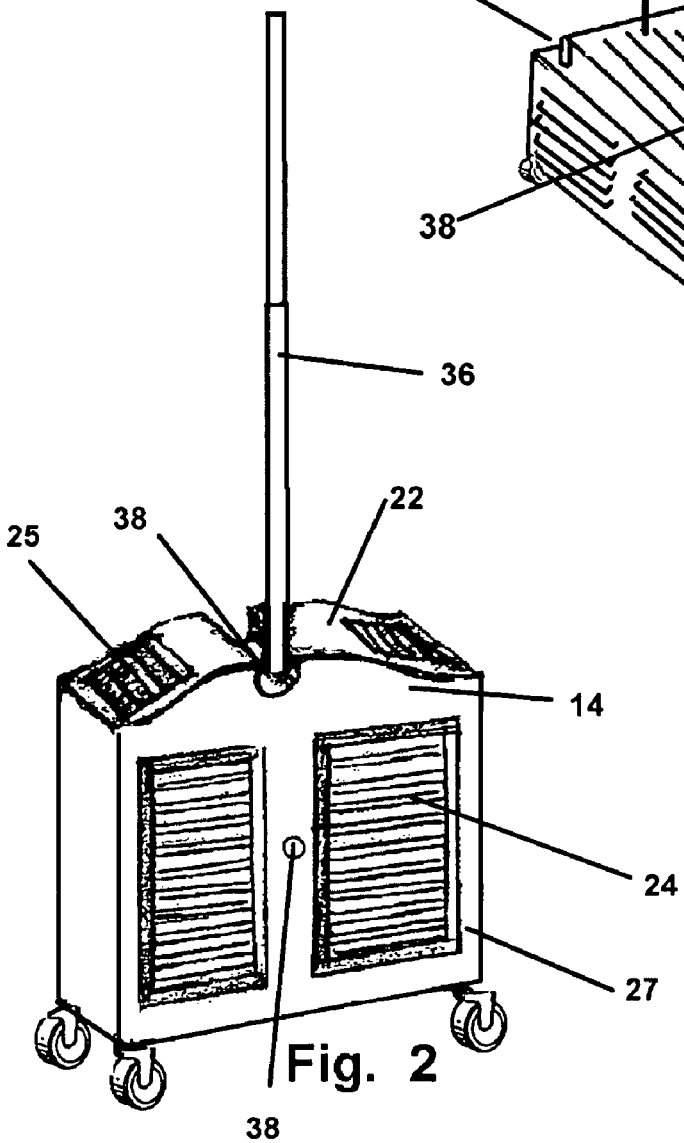
FIG. 2 depicts the device with the support for the horizontal member engaged with a short side surface and the housing in an elevated position.

Shown in FIG. 1 the device being employed in a horizontal position a fan 16 (FIGS. 3 and 3*a*) which is operationally engaged to the internal conduits 18 is switched to rotate in a manner along a first flow path to intake air through vent apertures 25 communicating through one or a plurality of conduit-engaged short sidewalls 22, and exhaust it through the vent apertures 27 communicating through the larger planar surface 24 which is horizontally disposed in FIG. 1. These vent apertures 25 and 27 may simply be gaps in the surfaces of the short sidewalls 22 and planar surface 24, or preferably they would be directionally engaged through the surfaces to provide a directional movement of exhausting air flow upward and inward when the device 10 is in a vertical position with the short sidewall down, to better dry clothing 30 or circulate exhausting clean air through the room.

As shown in FIG. 3, air flow may be reversed to flow along a second flow path for the vertical positioning of the device 10, by reversing the direction of the fan 16 operationally engaged to the conduits 18 such that intake airflow communicates through the vent apertures 27 of the larger planar surface 24 and is exhausted through the vent apertures 25 of a now horizontally disposed short sidewall 22. Only one short sidewall 22 need be engaged by conduits 18 to the central chamber 28 to exhaust or intake airflow depending on the direction of the fan 16. However more than one may be employed by adding conduits in communication with the central chamber 28.

As noted, the employment of a fan 16 that may be reversed, along with the perpendicularly disposed surfaces of the short sidewalls 22 and larger planar surface 24, provides a means to position the device 10 for drying of overhead clothing 30 in both an upright position as in FIG. 3, and substantially horizontal position with a low profile as in FIG. 1. The reversal may be automatic by using a position sensing component 33 such as an accelerometer or mercury switch such that whichever end is up will determine the path of exiting air. In this manner when the device 10 is vertically disposed with the large planar surface 24 is inclined or perpendicular to the floor, the air would automatically exhaust out the sidewall 22. The opposite would occur when the device 10 is disposed horizontally where the intake would be through the sidewall 22 and the air would exhaust through the large planar surface 24.

Particularly preferred are the placement of internal filters 32 at least in operable position between the fan 16 and the larger planar surface 24 and optionally between the fan 16 and the sidewall 22 intaking air. HEPA filters are preferred to filter pollutants and particulate from the airstream entering the housing in either direction. The filters are replaceable to allow the device to continue to clean air for its lifetime.

A means to support clothing 30 within the exhaust airstream or, if desired, the intake airstream, is provided in the form of a rack 36 which is adapted to support hangers 38 or other clothing supports. To enable the device 10 for both vertically disposed and horizontally disposed clothing drying, the rack 36 has means of engagement such as support aperture 38 formed which positions it above either of the two different surfaces depending on the user chosen disposition of the device 10. The rack 36 in a clothing support mode, is substantially "T" shaped as in FIGS. 1, 3, and 4 and has a horizontal cross bar 37 for hanger support. Centering the rack 36 over the vent apertures 25 or 27 of the surface above which it is engaged is preferred, especially if the vent apertures 25 and 27 communicate and provided a directional flow of the exhausting airstream. Such vent apertures 25 and 27 may be shaped like fins by bending the surface in-between to such apertures 25 and 27 at an angle to thereby provide directional flow.

The device is preferably supported on wheels 40 engaged to wheel mounts 42 which are engaged to the device 10 to provide wheeled support in either of the horizontal or vertically disposed positions. This allows for easy storage when in the horizontal position and in a low profile where the device 10 may be rolled under a bed. In the horizontal position, in order to fit under most beds in the United States, the sidewall 22 should be equal to, or between, 3 to 10 inches wide. In other words, it should position the planar surface 24, between 3 and 10 inches above the support surface for the device 10 in the horizontal position. Consequently the wheels 40, in order to maintain the low profile in the horizontal position, and keep the planar surface 24 under the bed, can be recessed into their engagement with the planar surface adjacent to the floor, or may be engaged to mounts on the sidewall 22 to keep the planar surface 24 sufficiently low to allow the device 10 to roll under a bed.

While all of the fundamental characteristics and features of the device herein and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A combination air purifier and clothes dryer comprising:

a housing, said housing having a first side surface and having a second side surface, a sidewall, said sidewall engaged to, and extending a first distance between, said first side surface and said second side surface;

said housing having an interior cavity defined by said first and second side surfaces and said sidewall;

said housing having a horizontal position wherein said first side surface is adjacent to a support surface and said second side surface is elevated said first distance above said first side surface;

said housing having a vertical position wherein said first and second side surfaces are positioned substantially normal to said support surface;

said sidewall in said vertical position having a first portion located adjacent to said support surface, and having a second portion opposite said first portion elevated a second distance above said first portion and atop said first side surface and said second side surface;

a central chamber positioned within said interior cavity;

a first conduit communicating between said central chamber and a first vent communicating through said second portion of said sidewall;

a second conduit communicating between said central chamber and a second vent communicating through said first side surface;

an electric fan positioned in said central chamber, said fan in operative communication with an electrical supply;

said electric fan being reversible to move air through said housing along either a first flow path or a second flow path;

said first flow path intaking air through said first vent and exhausting it through said second vent;

said second flow path intaking air through said second vent and exhausting it through said first vent;

a position sensing switch, said switch operatively engaged to said fan, said switch automatically switching said fan to communicate air along said first flow path when said housing is in said vertical position and along said second flowpath when said housing is in said horizontal position;

a clothes rack for holding clothing, said clothes rack engageable with said housing to position said clothing either in a first position adjacent to said first vent, or in a second position adjacent to said second vent;

said first distance of said sidewall sized to allow said housing in said horizontal position, to slide under a bed; and whereby said housing in said horizontal position with said fan directing said air along said first flow path communicates said air exhausting said second vent over said clothing in said second position, and said housing in said vertical position with said fan directing said air along said second flow path communicates said air exhausting said first vent over said clothing in said first position.

2. The combination air purifier and clothes dryer of claim 1 additionally comprising:

said first distance of said sidewall being a distance equal to or between 3 inches to 10 inches.

3. The combination air purifier and clothes dryer of claim 2 additionally comprising:

an air filter engaged within said internal cavity; and said first flow path and second flow path communicating air through said air filter.

4. The combination air purifier and clothes dryer of claim 3 additionally comprising:

said clothes rack being T-shaped and having first rack member with a first end engaging a central portion of a second rack member at a second end;

a first aperture formed in said second portion of said sidewall, said first aperture sized for frictional engagement with said first end of said first rack member;

a second aperture formed in said first side surface, said second aperture sized for frictional engagement with said first end of said first rack member; and whereby said first end of said first rack member is engageable with either of said first aperture or said second aperture to position said second rack member substantially parallel to said support surface and elevated above said first vent with said housing in said vertical position or said second vent when said housing is in said horizontal position.

5. The combination air purifier and clothes dryer of claim 2 additionally comprising:

said clothes rack being T-shaped and having first rack member with a first end engaging a central portion of a second rack member at a second end;

a first aperture formed in said second portion of said sidewall, said first aperture sized for frictional engagement with said first end of said first rack member;

a second aperture formed in said first side surface, said second aperture sized for frictional engagement with said first end of said first rack member; and whereby said first end of said first rack member is engageable with either of said first aperture or said second aperture to position said second rack member substantially parallel to said support surface and elevated above said first vent with said housing in said vertical position or said second vent when said housing is in said horizontal position.

6. The combination air purifier and clothes dryer of claim 5 additionally comprising:

a plurality of wheels; and said plurality of wheels engageable to said housing to hold it elevated above said support surface, in either said horizontal or vertical position.

7. The combination air purifier and clothes dryer of claim 2 additionally comprising:

a plurality of wheels; and said plurality of wheels engageable to said housing to hold it elevated above said support surface, in either said horizontal or vertical position.

8. The combination air purifier and clothes dryer of claim 3 additionally comprising:

a plurality of wheels; and said plurality of wheels engageable to said housing to hold it elevated above said support surface, in either said horizontal or vertical position.

9. The combination air purifier and clothes dryer of claim 1 additionally comprising:

an air filter engaged within said internal cavity; and said first flow path and second flow path communicating air through said air filter.

10. The combination air purifier and clothes dryer of claim 9 additionally comprising:

said clothes rack being T-shaped and having first rack member with a first end engaging a central portion of a second rack member at a second end;

a first aperture formed in said second portion of said sidewall, said first aperture sized for frictional engagement with said first end of said first rack member;

a second aperture formed in said first side surface, said second aperture sized for frictional engagement with said first end of said first rack member; and whereby said first end of said first rack member is engageable with either of said first aperture or said second aperture to position said second rack member substantially parallel to said support surface and elevated above said first vent with said housing in said vertical position or said second vent when said housing is in said horizontal position.

11. The combination air purifier and clothes dryer of claim 9 additionally comprising:

a plurality of wheels; and said plurality of wheels engageable to said housing to hold it elevated above said support surface, in either said horizontal or vertical position.

12. The combination air purifier and clothes dryer of claim 1 additionally comprising:

said clothes rack being T-shaped and having first rack member with a first end engaging a central portion of a second rack member at a second end;

a first aperture formed in said second portion of said sidewall, said first aperture sized for frictional engagement with said first end of said first rack member;

a second aperture formed in said first side surface, said second aperture sized for frictional engagement with said first end of said first rack member; and whereby said first end of said first rack member is engageable with either of said first aperture or said second aperture to position said second rack member substantially parallel to said support surface and elevated above said first vent with said housing in said vertical position or said second vent when said housing is in said horizontal position.

13. The combination air purifier and clothes dryer of claim 1 additionally comprising:

a plurality of wheels; and said plurality of wheels engageable to said housing to hold it elevated above said support surface, in either said horizontal or vertical position.

* * * * *